US005401369A

United States Patent [19]

Gershin

[11] Patent Number: 5,401,369

[45] Date of Patent: Mar. 28, 1995

[54] ELECTROPLATING PEN

[76] Inventor: Mircea-Mike Gershin, 87–49 86th St., Woodhaven, N.Y. 11421

[21] Appl. No.: 183,889

[22] Filed: Jan. 21, 1994

[51] Int. Cl.[6] ..... C25D 17/14; C25D 17/12

[52] U.S. Cl. ..... 204/224 R; 204/271; 204/288; 204/290 F

[58] Field of Search ..... 204/224 R, 271, 288, 204/289, 290 F

[56] References Cited

U.S. PATENT DOCUMENTS

| | | | |
|---|---|---|---|
| 3,520,792 | 7/1970 | Kerschgens | 204/271 X |
| 3,637,468 | 1/1972 | Icxi et al. | 204/224 R X |
| 4,159,934 | 7/1979 | Kadija | 204/271 X |
| 4,176,036 | 11/1979 | Rapids | 204/271 X |
| 4,668,364 | 5/1987 | Farmer et al. | 204/271 X |
| 4,992,154 | 2/1991 | Ida et al. | 204/271 X |

*Primary Examiner*—Donald R. Valentine
*Attorney, Agent, or Firm*—E. Michael Combs

[57] ABSTRACT

A pen structure arranged to effect electroplating of various plating solutions is available, having a removable anode, including a felt covering sheath extending thereover to enhance ease of use, speed, and accuracy in employment of the device.

5 Claims, 2 Drawing Sheets

ELECTROPLATING PEN

BACKGROUND OF THE INVENTION

1. Field of the Invention

The field of invention relates to electroplating apparatus, and more particularly pertains to a new and improved electroplating pen wherein the same is directed to the electroplating of various metals onto an associated workpiece.

2. Description of the Prior Art

Electroplating of various types is employed in the prior art such as indicated in U.S. Pat. Nos. 5,087,333; 5,045,167; and 5,124,016. Various electroplating solutions are indicated in U.S. Pat. Nos. 3,445,352 and 5,051,317.

The instant invention attempts to overcome deficiencies of the prior art by employing a pen structure having an elongate anode tip arranged for directing a plating solution onto a workpiece in a precise and controlled manner and in this respect, the present invention substantially fulfills this need.

SUMMARY OF THE INVENTION

In view of the foregoing disadvantages inherent in the known types of electroplating apparatus now present in the prior art, the present invention provides an electroplating pen having an-elongate projecting anode, having a fibrous covering sheath arranged to direct electroplating solution onto a workpiece surface. As such, the general purpose of the present invention, which will be described subsequently in greater detail, is to provide a new and improved electroplating pen which has all the advantages of the prior art electroplating apparatus and none of the disadvantages.

To attain this, the present invention provides a pen structure arranged to effect electroplating of various plating solutions, having a removable anode, including a felt covering sheath extending thereover to enhance ease of use, speed, and accuracy in employment of the device.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electroplating pen which has all the advantages of the prior art electroplating apparatus and none of the disadvantages.

It is another object of the present invention to provide a new and improved electroplating pen which may be easily and efficiently manufactured and marketed.

It is a further object of the present invention to provide a new and improved electroplating pen which is of a durable and reliable construction.

An even further object of the present invention is to provide a new and improved electroplating pen which is susceptible of a low cost of manufacture with regard to both materials and labor, and which accordingly is then susceptible of low prices of sale to the consuming public, thereby making such electroplating pens economically available to the buying public.

Still yet another object of the present invention is to provide a new and improved electroplating pen which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
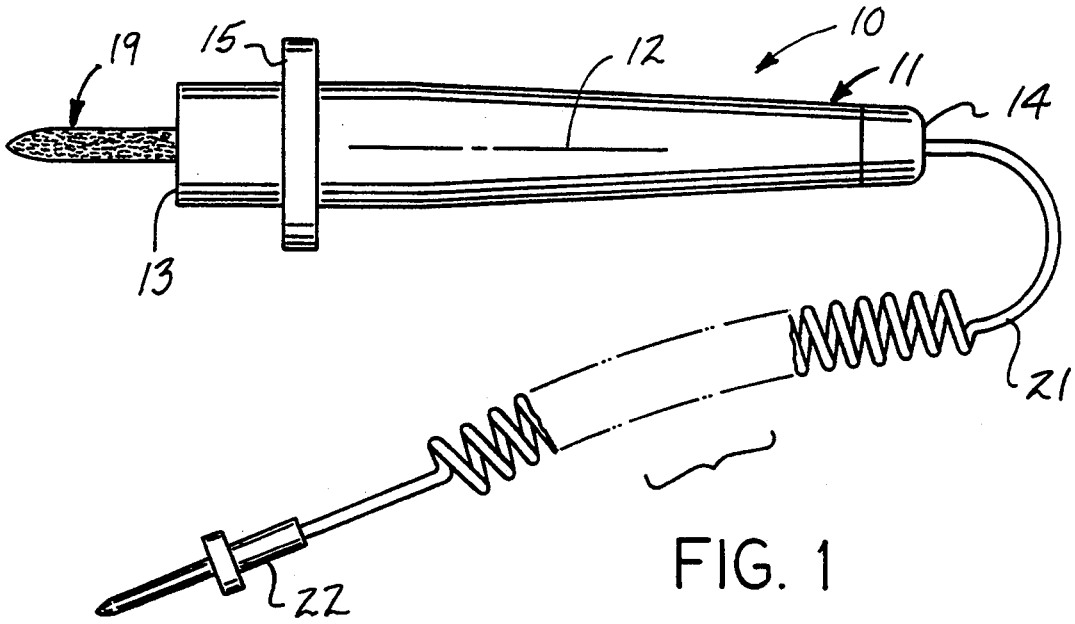
FIG. 1 is an orthographic side view of the invention.

With reference now to the drawings, and in particular to FIG. 1 to 8 thereof, a new and improved electroplating pen embodying the principles and concepts of the present invention and generally designated by the reference numeral 10 will be described.

Figure 2:
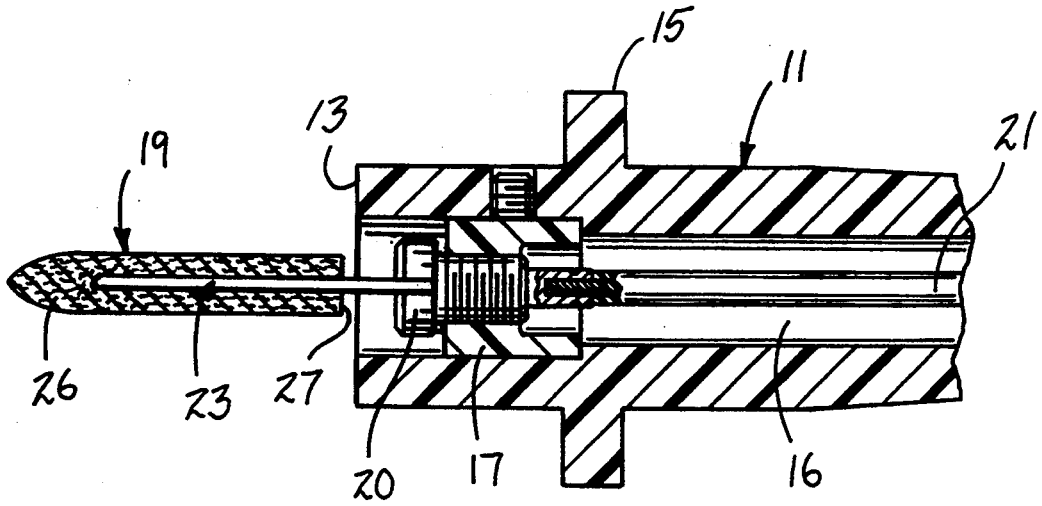
FIG. 2 is an orthographic cross-sectional illustration of a forward portion of the pen structure.
Figure 3:
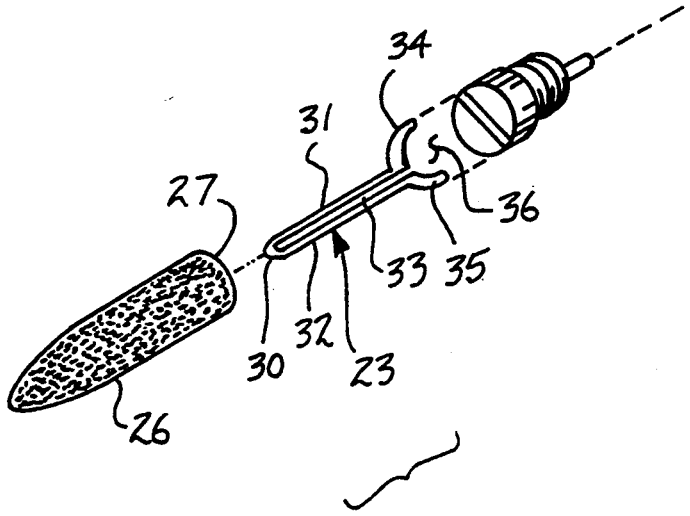
FIG. 3 is an isometric exploded view of the anode.
Figure 4:
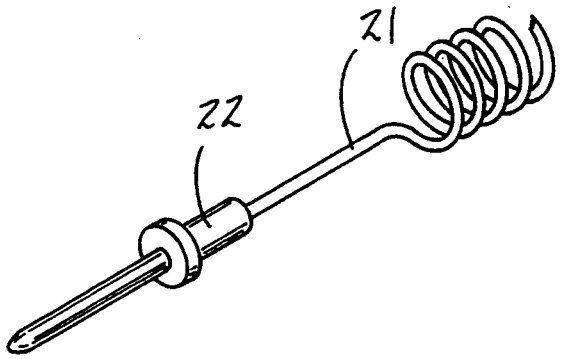
FIG. 4 is an isometric illustration of the electrical cable connector structure.

More specifically, the electroplating pen 10 of the instant invention essentially comprises an elongate body 11 symmetrically oriented about a body axis 12. The body includes a body first end 13 spaced from a body second end 14, with an annular abutment flange 15 coaxially oriented relative to the axis 12 fixedly mounted to the exterior surface of the body 11 in spaced adjacency to the first end 13. A central body cavity 16 is directed coextensively of the body from the first end 13 through the second end 14. A mounting plug 17 is directed into the body cavity 16 between the abutment flange 15 and the first end 13. A mounting plug 17, as illustrated in FIG. 2, includes a plug fastener 18 directed threadedly through the body 11 into engagement with the mounting plug 17 secured to the mounting plug in a replaceable manner within the body cavity. The mounting plug 17 further includes an anode fastener 20 having a fastener slot 20*a* and arranged for securing the anode member 23 to the plug fastener to permit the anode to project coaxially aligned relative to the body 11 from the body first end 13. To this end, the anode assembly 19 includes an anode member 23 terminating in a tip 30, with the anode member 23 and the tip 24 coaxially aligned relative to the body axis 12. A fibrous felt sheath 26 is provided coaxially aligned to the axis 11 receiving the anode member 23 through the felt sheath rear wall 27. In this manner, a plating solution of any desired type for plating of various gold, silver, and metals for example may be absorbed by the sheath for plating upon a workpiece (not shown). Typically but not in terms of limitation, the anode is formed of 0.032 inch gauge metal. The anode member is preferably formed of titanium plated with platinum. In use, plating solution is directed into the elongate channel 33 (see FIG. 3) oriented between the first and second leg rods 31 and 32 extending from the anode tip 30. Such plating solution (not shown) of any conventional type to include plating of gold, chromium, copper, platinum, silver, and the like is directed into the elongate channel 33 and pressured therein by the air trap spacing 36 oriented between the first and second mounting legs 34 and 35, that in turn are secured to the fastener slot 20*a* of the fastener 20. Atmospheric pressure pressurizes such solution from the air trap spacing 36 into the elongate channel 33 permitting the use of the 0.032 inch gauge anode member 23. It should also be noted that the heath 26 may include or be formed of a brush-like member as another manner of applying the plating solution. Further, the sheath is typically formed as one millimeter thickness to provide the proper spacing ratio from the anode to the cathode (workpiece) that is to receive the plating. The sheath may range up to two millimeters but this ratio is critical in the proper plating of material employing the instant invention. This kind of anode construction provides an anode to cathode ratio in the area of 1:98 percent for enhanced efficiency of directing electroplating liquid solution onto a cathode workpiece. It should also be understood the instant invention may be directed to commercial application, wherein in lieu of merely saturating the sheath member 26 with electroplating solution, solution may be pumped to the sheath from a mixing vat of construction known in the prior art per se. The mixing vat or chamber would then pump such solution to the anode member for application to a cathode workpiece.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may by resorted to, falling within the scope of the invention.

What is claimed as being new and desired to be protected by Letters Patent of the United States is as follows:

1. An electroplating pen, comprising, an elongate body having a body axis, wherein the body includes a body first end spaced from a body second end, and a central body cavity directed through the elongate body extending into the body first end, with a mounting plug secured within the body cavity in spaced adjacency to the body first end, and a plug fastener threadedly directed through the elongate body in contiguous communication with the mounting plug for securement of the mounting plug within the body cavity, and an elongate anode coaxially aligned relative to the elongate body projecting from the body first end and extending therebeyond, with the anode having an anode fastener securing the anode to the mounting plug, and the anode includes an elongate anode member, having a first leg rod spaced from a second leg rod defining an elongate channel therebetween.

2. A pen as set forth in claim 1 wherein the first leg rod including a first mounting leg extending from the first leg rod and a second mounting leg extending from the second leg rod, wherein an air trap spacing is oriented between the first mounting leg and the second mounting leg, with the air trap spacing in pneumatic communication with the elongate channel, the elongate channel of a first width, the air trap spacing of a second width greater than the first width, and the anode fastener includes a fastener slot receiving the first mounting leg and the second mounting leg securing the first mounting leg to the second mounting leg.

3. A pen as set forth in claim 2 and a fibrous sheath receiving the anode member, the fibrous sheath having a sheath cavity receiving the anode member therewithin.

4. A pen as set forth in claim 3 wherein the anode member is formed of 0.032 inch gauge titanium, having a platinum plating coextensive thereof, with the fibrous sheath having an exterior surface spaced from the sheath cavity a spacing substantially equal to one millimeter.

5. An electroplating pen, comprising, an elongate body having a body axis, wherein the body includes a body first end spaced from a body second end, and a central body cavity directed through the elongate body extending into the body first end, with the mounting plug secured within the body cavity in spaced adjacency to the body first end, and an elongate anode coaxially aligned relative to the elongate body projecting from the body first end and extending therebeyond, with the anode having an anode fastener securing the anode to the mounting plug, and the anode includes an elongate anode member, having a first leg rod spaced from a second leg rod defining an elongate channel therebetween.

* * * * *